US005907334A

United States Patent [19]

Hirano et al.

[11] Patent Number: 5,907,334

[45] **Date of Patent: *May 25, 1999**

[54] RECORDING APPARATUS AND METHOD USING PLURAL INTERCONNECTABLE CARRIAGES THAT ARE RELEASABLE AT A CAPPING POSITION

[75] Inventors: Hirofumi Hirano; Shinichi Omo; Hiroshi Fukui, all of Yokosuka, Japan

[73] Assignee: Canon Kabushiki Kaisha, Tokyo, Japan

[ * ] Notice: This patent is subject to a terminal disclaimer.

[21] Appl. No.: 08/205,130

[22] Filed: Mar. 1, 1994

Related U.S. Application Data

[60] Continuation of application No. 07/939,706, Sep. 2, 1992, abandoned, which is a division of application No. 07/674,946, Mar. 26, 1991, Pat. No. 5,166,708, which is a continuation of application No. 07/317,928, Mar. 2, 1989, Pat. No. 5,018,884.

[30] Foreign Application Priority Data

| | | | |
|---|---|---|---|
| Mar. 2, 1988 | [JP] | Japan | 63-049194 |
| Mar. 2, 1988 | [JP] | Japan | 63-049197 |
| Feb. 28, 1989 | [JP] | Japan | 1-047400 |

[51] Int. Cl.[6] ..... B41J 2/165

[52] U.S. Cl. ..... 347/23; 400/126

[58] Field of Search ..... 347/23, 24, 29, 347/30, 32, 37, 87; 400/82; B41S 2/165

[56] References Cited

U.S. PATENT DOCUMENTS

| | | | |
|---|---|---|---|
| 3,858,703 | 1/1975 | Duley | 197/1 R |
| 3,930,258 | 12/1975 | Dick et al. | 346/75 |
| 4,030,590 | 6/1977 | Wojdyla | 197/1 R |
| 4,123,761 | 10/1978 | Kimura et al. | 346/140 R |
| 4,204,779 | 5/1980 | Lee et al. | 400/144.2 |
| 4,278,984 | 7/1981 | Matsumot et al. | 346/140 R |
| 4,329,698 | 5/1982 | Smith | 347/87 X |
| 4,403,233 | 9/1983 | Terasawa et al. | 346/140 R |
| 4,407,003 | 9/1983 | Fukui | 346/76 PH |
| 4,410,900 | 10/1983 | Terasawa | 346/140 R |

(List continued on next page.)

FOREIGN PATENT DOCUMENTS

| | | |
|---|---|---|
| 0082336 | 6/1983 | European Pat. Off. . |
| 0145025 | 6/1985 | European Pat. Off. . |
| 2916263 | 11/1979 | Germany . |
| 2934947 | 3/1980 | Germany . |
| 56-005775 | 1/1981 | Japan . |
| 56-120361 | 9/1981 | Japan . |
| 60-12946 | 4/1985 | Japan . |
| 61-134275 | 6/1986 | Japan . |
| 61-135770 | 6/1986 | Japan . |
| 62-116169 | 5/1987 | Japan . |
| 1559970 | 1/1980 | United Kingdom . |

OTHER PUBLICATIONS

IBM Technical Disclosure Bulletin, "High Speed Printer", Powletko et al. vol. 19, No. 9, pp. 3355 and 3356 (Feb. 1977).

K.R. Primmer, "Start/Stop Valve for Ink Jet Printer", *IBM Technical Disclosure Bulletin,* vol. 22, No. 10, pp. 4409–4410, Mar. 1980.

*Primary Examiner*—Benjamin R. Fuller
*Assistant Examiner*—C. Dickens
*Attorney, Agent, or Firm*—Fitzpatrick, Cella, Harper & Scinto

[57] ABSTRACT

A recording apparatus includes first and second carriers, a capping device and a switching device. The first carrier is movable by a drive force, and the second carrier is movable when connected to the first carrier. The second carrier carries an ink jet head thereon. The capping device caps the ink jet head when the ink jet head is mounted on the second carrier and the second carrier is located at a capping position. The switching device switches between a first mode and a second mode. In the first mode, the ink jet head is capped by the capping device. In the second mode, the first and second carriers are integrally connected and are capable of moving together to effect recording by the ink jet head in a full recording range.

32 Claims, 9 Drawing Sheets

U.S. PATENT DOCUMENTS

| | | | |
|---|---|---|---|
| 4,428,693 | 1/1984 | Bovio et al. | 400/126 |
| 4,492,969 | 1/1985 | Terasawa | 346/140 R |
| 4,506,277 | 3/1985 | Terasawa | 346/140 R |
| 4,576,490 | 3/1986 | Isobe | 400/82 |
| 4,628,333 | 12/1986 | Terasawa | 346/140 R |
| 4,631,554 | 12/1986 | Terasawa | 346/140 R |
| 4,675,696 | 6/1987 | Suzuki | 346/46 |
| 4,680,696 | 7/1987 | Ebinuma et al. | 346/75 |
| 4,725,861 | 2/1988 | Oda | 346/140 R |
| 4,825,231 | 4/1989 | Nozaki | 346/140 R |
| 4,847,637 | 7/1989 | Watanabe et al. | 346/140 R |
| 4,999,643 | 3/1991 | Terasawa | 346/140 R |
| 5,018,884 | 5/1991 | Hirano et al. | 400/126 |
| 5,086,305 | 2/1992 | Terasawa | 346/140 R |
| 5,166,708 | 11/1992 | Hirano et al. | 346/140 R |

DETECT INK
S113
EXCITE CR MOTOR IN A RIGHT DIRECTION
S114
SET HEAD PRINT DATA
S115
HEATING IS ON
S116
t1
S117
HEAD HEATING IS OFF
S118
ADD 1 TO RECORDING CYCLE COUNTER
S119
S120
IS RECORDING CYCLE COUNTER MAXIMUM ?
NO
YES
CR PROCESS
S121
LF PROCESS
S122
RET

RECORDING APPARATUS AND METHOD USING PLURAL INTERCONNECTABLE CARRIAGES THAT ARE RELEASABLE AT A CAPPING POSITION

This application is a continuation of application Ser. No. 07/939,706 filed Sep. 2, 1992, now abandoned, which is a division of application of application Ser. No. 07/674,946 filed Mar. 26, 1991, now U.S. Pat. No. 5,166,708, which is a continuation of application Ser. No. 07/317,928, filed Mar. 2, 1989, now U.S. Pat. No. 5,018,884.

BACKGROUND OF THE INVENTION

1. Field of the Invention

This invention relates to a serial type recording apparatus and method which is applicable to a recording apparatus in a business machine or a communication instrument such as a copying machine, a facsimile apparatus, a personal computer or an office computer, and in particular to a recording apparatus and method which can be effectively applied to an ink jet recording apparatus in which a carrier is caused to scan in the direction of a recording column to thereby accomplish recording.

2. Related to Background Art

Among the serial type recording apparatuses, such as ink jet recording apparatuses, wire dot printers and heat transfer printers, proposed before the present invention, there is one in which a recording head is carried on a single carriage and when image recording using different ink is to be effected, the recording head is interchanged with another recording head by a manual operation. However, in such an apparatus, it is not intended that a plurality of recording heads be carried on the carriage to effect color recording, and such apparatus is not constructed so that a plurality of recording heads can be carried on the carriage. In any case, black documents and the black printing mode data processing are more often used for printing in a terminal instrument than colored graphics and colored documents.

Instead of the manual operation, it is conceivable to move a carriage carrying a plurality of recording heads thereon serially to thereby enable printing in any color to be accomplished, but this will result in an unused construction in which a recording heads are always moved or continue to be moved in a state capable of recording. Accordingly, in the heretofore known ink jet recording, a recording heads are subjected to the recovery process or ink is heated, which leads particularly to the waste of time and the waste of electric power. Also, the carriage carries the maximum weight thereon at all times and, therefore, the load for moving the carriage becomes great.

On the other hand, a color ink jet printer carried recording heads for four colors, i.e., Bk (black), Y (yellow), M (magenta) and C (cyan) in parallel on a single carriage and has effected printing by causing the carrier to scan.

However, in the ink jet printer, during black printing, the other printing heads are exposed to the atmosphere, and this causes problems such as clogging and adherence resulting from the desiccation of ink. These problems arise earlier in a recording head not being used than in a recording head being used, and even if the recovery process is carried out, the period during which these problems arise becomes very short. During recovery process, it is usually the practice to return the carriage periodically to its home position even during black printing to thereby effect idle discharge, or to effect suction of ink from the color printing heads even during the closing of the main switch or the suction recovery operation,. and this brings about the inconvenience that the recording time is prolonged. Also, by this recovery process, the color inks are wastefully consumed, and this has been uneconomical.

Also, even when high-speed printing is to be effected, it has been necessary to drive the heavy carrier carrying the four recording heads thereon and thus, an expensive and bulky motor for driving the carrier has been necessary.

Even in printing conditions under which black printing can be executed, the absence of other color inks makes printing impossible.

Also, in spite of the execution of printing being possible if the temperature control of only the black head is effected in printing conditions under which black printing can be executed, waste such as affecting the temperature control of the other color heads, for example, warming all the heads so as to assume 35° C. or higher, is unavoidable.

The present invention has been made on the basis of the above-described background art, and more particularly from a point of view which has not heretofore been foreseen.

SUMMARY OF THE INVENTION

The present invention has as its technical task to solve the above-noted problems peculiar to the above-described background art, and provides a recording apparatus which is excellent in operability and which can greatly reduce the waste heretofore required in recording.

It is a primary object of the present invention to provide a recording apparatus which can operate in a plurality of different recording modes while recording efficiently.

It is another object of the present invention to provide an ink jet recording apparatus in which when recording with a particular color, for example "black," and color recording are to be effected, the load of a drive source is mitigated and recording of the particular color is effected at a high speed and color recording is effected at a low speed to ensure reliable recording.

It is still another object of the present invention to provide an ink jet recording apparatus in which the preparation control and/or the recovery control of a plurality of ink jet recording heads is effected wastelessly and a decrease in the recording time or a decrease in the amount of consumed ink is achieved.

It is still another object of the present invention to provide a suction recovery method for an ink jet recording apparatus that includes a first cap for performing suction recovery of a first ink jet recording head, a second cap for performing suction recovery of a second ink jet recording head, and a pump. The method includes performing suction recovery of at least one of the first and second ink jet recording heads by switching a switch mechanism between a first position for communicating the first and second caps with the pump and a second position for communicating the first cap with the pump.

Other objects of the present invention will become apparent from the following description.

An embodiment of the present invention achieves the above objects by carrying a recording head for black printing and a recording head for color printing on discrete carriers to thereby allow only the head for black printing to scan during black printing. Therefore, during black printing, the head for color printing may remain capped and does not unnecessarily consume color ink and the clogging of the nozzle of the recording head for color printing can be prevented. Also, the carrier carrying only the head for black printing thereon is small and light in weight and therefore does not require a relatively large motor for scanning at a high speed.

In another embodiment of the present invention, a head for black printing and a head for color printing are carried on discrete carriers, whereby during black printing the suction recovery operation of only the head for black printing is executed. In some-cases, the idle discharge control of the printing head thereof is not effected, but the head is scanned and driven under such conditions that it is warmed so as to assume a predetermined minimum temperature, e.g. 35° C., and the ink detection or control of only black ink is effected.

In this case, the head for color printing may remain capped and the suction recovery operation, the idle discharge operation, the temperature control or the color ink detection for this head is not necessary and, therefore, not effected. Thus, color ink is not unnecessarily consumed, clogging of the nozzle of this head can be prevented, and unnecessary control means can be curtailed.

In still another embodiment of the present invention, before the recording of one scan of a carriage is started, it is determined whether recording is a recording mode using a plurality of recording heads or a recording mode using a particular, for example during black printing therefore, only the appropriate recording head is used for each scan, whereby the mitigation of the driving load and an improvement in the recording speed are achieved. Also, in an improved modification of this embodiment, recording signals in a plurality of scanning ranges are discriminated the and appropriate selection of a recording head that can shorten the recording time the most is effected, whereby further shortening of the general recording time is achieved. For example, where a small amount of scan from after the start of one scan is only black printing and the rest of the scan is color printing and the next whole one scan is color printing, the sum of the time during which the separating operation and the connecting operation of a plurality of carriages are effected and the time required for the carriage for black to be returned to a color printing area becomes long as compared with the time required when only black printing is effected at a speed whereat all recording heads have been moved and subsequently color printing is effected without return of the heads In such case, even if there is printing of only black, the carriages as they are connected together are driven from the start of the first scan till the completion of two scans. Accordingly, the recording time as a whole becomes short. Where this comparative discrimination is converse, printing by only the black carriage is effected, and then color printing is effected after the carriage connecting mode has been entered.

In the present invention, recording modes includes 1) two kinds of modes, i.e., a first mode in which only one recording head when mode change-over is automatically effected by first and second recording heads using dark black ink and light black ink, respectively, and a second mode in which the first and second recording heads are both moved; or 2) the recording by one of first and second recording heads using two different color inks, respectively, and carried on discrete carriages which is more adjacent to the recording area, and the two-color recording by the first and second recording heads.

Further features of the present invention will be understood from the following detailed description of some embodiments thereof.

DESCRIPTION OF THE PREFERRED EMBODIMENTS

An embodiment of the present invention will hereinafter be described with reference to the drawings.

Figure 1:
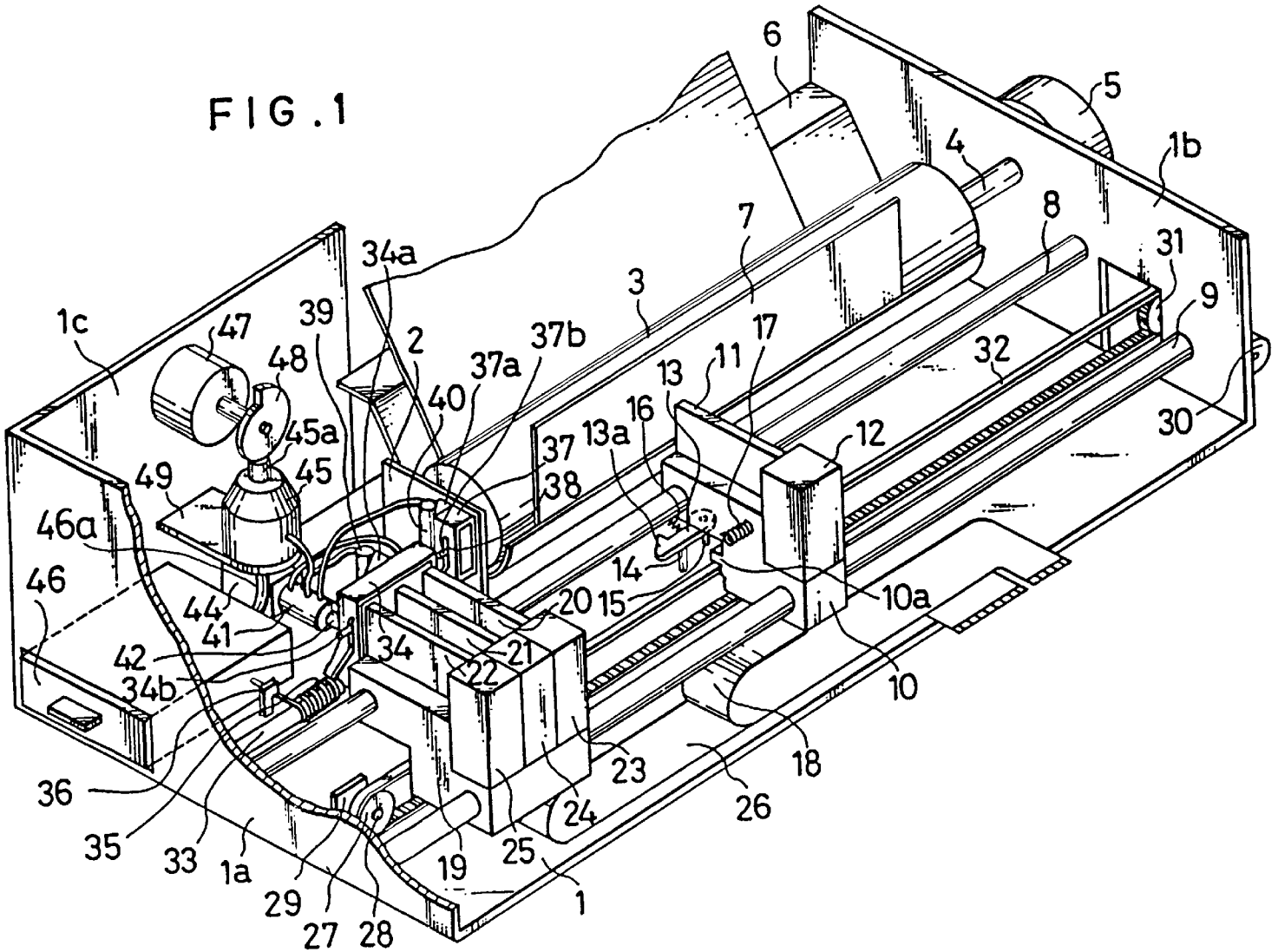
FIG. 1 is a general perspective view showing an embodiment of an ink jet recording apparatus according to the present invention.

FIG. 1 is a perspective view showing an embodiment of the present invention.

The reference numeral 1 designates a base formed with a left side plate 1*a* and a right side plate 1*b,* and a rear side plate 1*c*.

The reference numeral 2 denotes an intermediate side plate provided upright at a predetermined location on the base 1. The reference numeral 3 designates a platen roller formed of an elastic material of great coefficient of friction such as rubber. The reference numeral 4 denotes a platen roller shaft extending through the center of the platen roller 3 and rotatably supported on the right side plate 1*b* and the intermediate side plate 2. The reference numeral designates a paper feeding motor fixed to the right side plate 1*b* and adapted to rotate the platen roller shaft 4 through a gear train, not shown. The reference numeral 6 denotes a paper pan extending from the rear of the platen roller 3 and below the platen roller and guiding a sheet or paper forwardly. The reference numeral 7 designates a printing sheet wound on the platen roller 3 and urged against the platen roller 3 with a predetermined pressure force by a pinch roller, not shown. The printing sheet 7 is conveyed in synchronism with the rotation of the platen roller 3.

The reference numeral 8 denotes an A guide shaft, and the reference numeral 9 designates a B guide shaft. The A and B guide shafts 8 and 9 are supported parallel to each other on the left side plate 1*a* and the right side plate 1*b*.

The reference numeral 10 denotes a carrier for a black ink recording head (hereinafter referred to as the black carrier). The black carrier 10 is slidably supported on the A guide shaft 8 and the B guide shaft 9. The black carrier 10 is formed with a clamp portion 10*a* having a groove having inside thereof teeth similar in shape to a timing belt, which will be described later, in order to clamp the timing belt.

The reference numeral 11 designates a black ink recording head (hereinafter referred to as the black head) carried on the black carrier 10.

The reference numeral 12 denotes a tank containing black ink therein. The tank 12 is removably mounted on the black carrier 10, and the ink is supplied therefrom to the black head 11 through a supply systems not shown. The reference numeral 13 designates a connecting lever having a hook portion 13*a* formed at the fore end thereof and having a control pin 24 studded in the lower portion thereof. The connecting lever 13 is rotatably supported on a rotary shaft 15 studded in the lower portion of the black carrier 10, and is biased in one direction by a spring 16. The reference numeral 17 denotes a compression spring mounted at a predetermined location on the black carrier 10 and adapted to be compressed when coupled to a carrier 19 for color printing which will be described later, to thereby bias it in a direction to separate the carriers 10 and 19 from each other and eliminate the back-lash during the connection.

The reference numeral 18 designates a flexible cable which electrically connects the black head 11 to a control board, not shown.

The reference numeral 19 denotes a carrier for color printing (hereinafter referred to as the color carrier). The color carrier 19, like the black carrier 10, is slidably supported on the A guide shaft 8 and the B guide shaft 9.

FIG. 2 shows the operation of the connecting portion between the black carrier 10 and the color carrier 19.

An engagement pin 19*a* for engaging with the connecting lever 13 is formed on the lower portion of the color carrier 19, as shown in FIG. 2.

A Y (yellow) head 20, an M (magenta) head 21 and a C (cyan) head 22 are mounted at a predetermined pitch on the color carrier 19.

Also, a Y (yellow) tank 23, an M (magenta) tank 24 and a C (cyan) tank 25 are removably mounted on the color carrier 19.

The reference numeral 26 designates a flexible cable for color.

The reference numeral 27 denotes a tension pulley rotatably supported on a shaft 28.

The shaft 28 is studded on a tension plate 29, and is fixed by imparting predetermined tension to a timing belt which will be described later.

A carrier motor 30 is mounted on the right side plate 1*b*, and a pulley 31 is fixed to the shaft thereof. The reference numeral 32 designates a timing belt mounted on the pulley 31 and the tension pulley 27 with predetermined tension and coupled to the black carrier 10 at a clamp portion 1*a*. Accordingly, the black carrier 10 is scanned and driven by the rotation of the carrier motor 30.

The reference numeral 33 denotes a cap guide shaft supported between the left side plate 1*a* and the intermediate side plate 2. The reference numeral 34 desigantes a cap for the color heads 20, 21 and 22 (hereinafter referred to as the color cap.) The color cap 34 is slidably and rotatably held on the cap guide shaft 33. Denoted by 34*a* is an opening-closing cam formed integrally with the color cap 34 and having an inclined surface portion formed on one side thereof. By this opening-closing cam 34*a* bearing against an opening-closing pin 39 (FIG. 3) which will be described later, the color cap 34 is moved while pivoting toward the printing head. The color cap 34 is engaged with the carrier 19 by an engagement portion, not shown, and is capped onto the head when the color carrier 19 is scanned toward the left side plate 1*a*.

Designated by 34*b* is a spring hooking shaft studded on the color cap 34.

The reference numeral 35 denotes a compression torsion spring having the functions of a compression spring and a torsion spring. The compression-torsion spring is inserted in the cap guide shaft 33, and one end thereof is hooked on the spring hooking shaft 34*b* of the color cap 34 and the other end thereof is hooked on a hook 36 rising from the base 1.

The reference numeral 37 designates a cap for capping the recording head for black printing thereinafter referred to as the black cap). The black cap 37, like the color cap 34, is slidably and rotatably supported on the cap guide shaft 33, and is moved by an engagement portion, not shown, in synchronism with the movement of the black carrier 10 and is operated by an opening-closing cam 37*a* so as to cap the black head 11.

The reference numeral 38 denotes a compression torsion spring which, like the aforedescribed compression torsion spring 35, is mounted on a spring hooking shaft 37*b*.

The reference numerals 39 and 40 designate opening-closing pins studded on the base 1. The opening-closing cams 34*a* and 37*a* bear against the opening-closing pins 39 and 40, respectively.

The reference numeral 41 denotes a change-over valve having a piston 41*a* (FIG. 2) in which a flow path is formed. By the piston 41*a* being moved in a cylinder 41*b*, the black cap and the color cap are changed over to a case where the color cap 34 is communicated with a pump and a case where both of the black cap and the color cap are communicated with the pump, as shown in FIG. 2.

The reference numeral 42 (FIGS. 1, 2A and 2B) designates a change-over shaft secured to the piston 41*a* of the change-over valve 41 and adapted to be synchronized with the movement of the piston 41*a*.

The reference numeral 43 (FIGS. 2A and 2B) denotes a change-over plate mounted on the fore end of the change-over shaft 42. When the piston 41*a* is moved toward the carrier side (the normal position of FIG. 2B), the change-over plate 43 bears against the control pin 14 of the connecting lever 13 and therefore, the connecting lever 13 and the engagement pin 19*a* of the color carrier 19 do not come into engagement with each other.

Figure 2A:
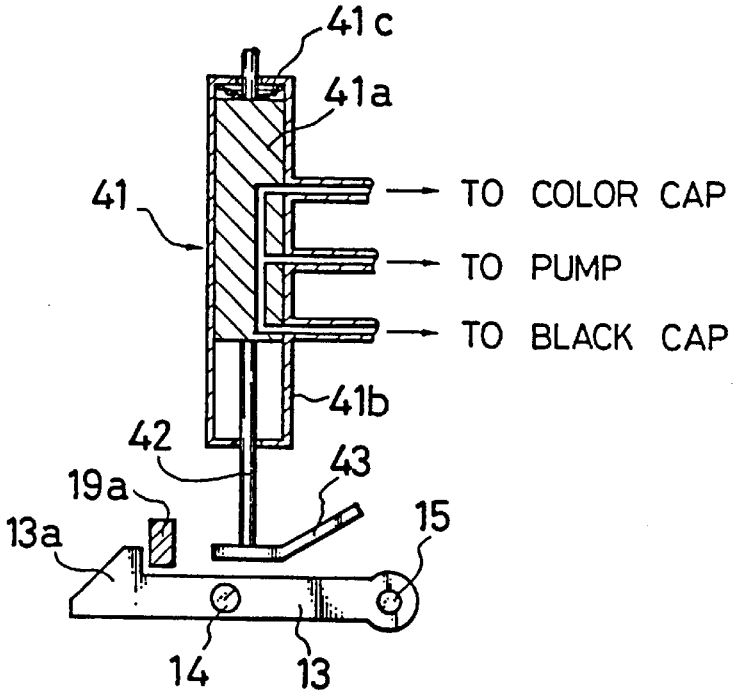
FIGS. 2A and 2B are fragmentary cross-sectional views showing the cap changing-over operation of the recovery system in FIG. 1.

The reference numeral 44 designates a solenoid connected to the piston 41*a*. When electric power is supplied to the solenoid 44 to attract it, it causes the piston 41*a* to move against the force of a spring 41*c*, as shown in FIG. 2A. At this time, the change-over plate 43 is retracted and therefore, the connecting lever 13 and the engagement pin 19*a* come into engagement with each other, and the black carrier 10 and the color carrier 19 are connected together and become movable as a unit. The reference numeral 45 denotes a pump. By the shaft 45*a* of the pump 45 being pushed into the pump, negative pressure can be generated in the pump to thereby suck the ink from the black cap 37 and the color cap 34.

The pump 45 is mounted on the rear side plate 1*c* by means of a mounting plate 49.

The reference numeral 47 designates a recovering motor mounted on the rear side plate 1*c*. A cam 48 is secured to the shaft of the recovering motor 47, and the cam 48 is rotated by the rotation of the recovering motor 47, and the shaft 45*a* of the pump 45 is pushed in by the cam portion of the cam 48 to thereby operate the pump 45.

The reference numeral 46 denotes a discharged liquid tank for collecting liquid discharged from the pump 45. The discharged liquid tank 46 is installed at a predetermined location. The reference numeral 46*a* designates a discharged liquid tube for guiding the discharged ink.

The operation of the above-described color ink jet recording apparatus will now be described.

Figure 2B:
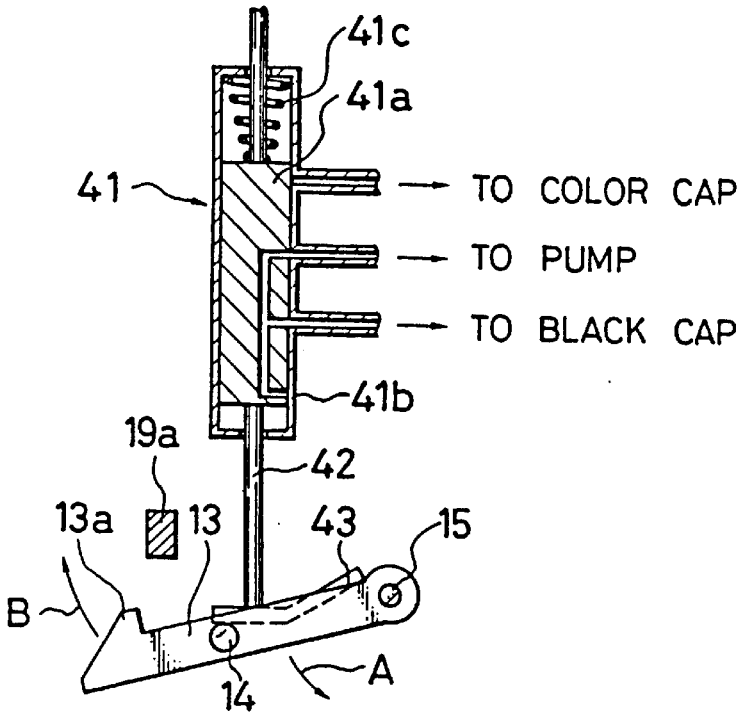
Figure 3A:
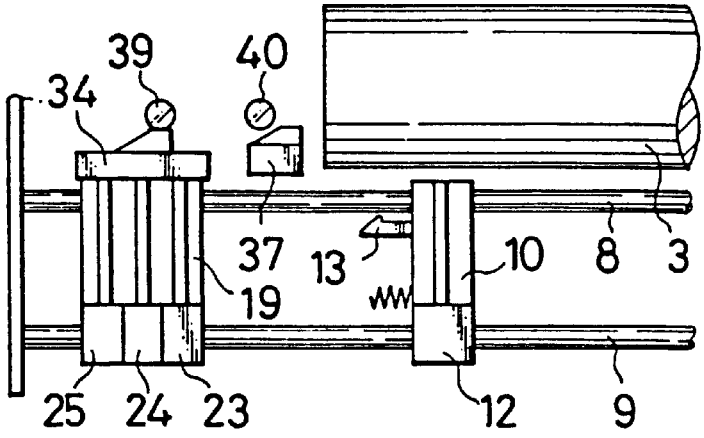
FIGS. 3A–3C are fragmentary plan views showing the scanning by the connection and separation of the two carriages in FIG. 1.

First, during black printing, as shown in FIG. 3A, only the black carrier 10 scans in the direction of print column and effects printing. At this time, the solenoid 44 is not electrically energized and as shown in FIG. 2B, the piston 41*a* is moved toward the black carrier 10 by the spring 41*c* and stopped thereat. When the black carrier 10 is returned to its home position for preliminary discharge or capping, the black carrier 10 first comes into engagement with the black cap 37, and the black cap 37 also moves in synchronism with the movement of the black carrier 10, and the opening-closing cam 37 bears against the opening-closing pin 40, whereby the black cap 37 is urged against the black head 11 and caps the latter. At this time, as shown in FIG. 2B, the change-over plate 43 is within the range of movement of the connecting lever 23 and therefore, as shown in FIG. 2B, the change-over plate 43 bears against the control pin 14 of the change-over lever 13 and the change-over lever 13 is rotated in the direction of arrow A and therefore, the hook portion 13*a* does not come into engagement with the engagement pin 19*a* of the color carrier 19. Also, since the black cap 37 is in communication with the pump, the change-over valve 41 sucks the ink from only the black head 11 even if the ink is sucked by the pump 45.

Even if in the state of FIG. 2B, the black carrier 10 scans in the rightward direction for printing, the color carrier 19 remains stopped at its original position. In this manner, during normal printing, only the black carrier 10 scans and the recovering system also acts on only the black head 11.

Description will now be made of the scanning of the color carrier 19 for color printing. When as previously described, the solenoid 44 is electrically energized to pull the piston 41*a* to a state in which the black carrier 10 is capping, the changeover plate 43 is retracted as shown in FIG. 2A and the connecting lever 13 is pulled by the spring 16 and rotated thereby in the direction of arrow 3, and becomes connected to the engagement pin 19*a* of the color carrier 19. At this time, a slight gap At is created between the hook portion 13*a* and the engagement pin 19*a,* but this gap Δl is eliminated by the compression spring 17 when the black carrier 10 is moved to the left and connected to the color carrier 19

Figure 3B:
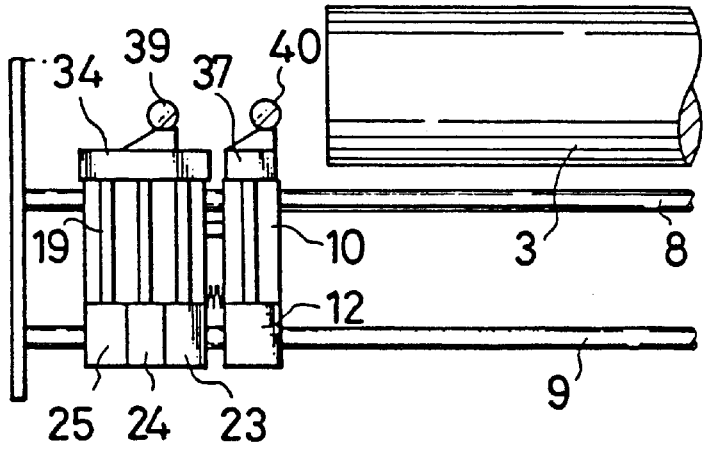
Figure 3C:
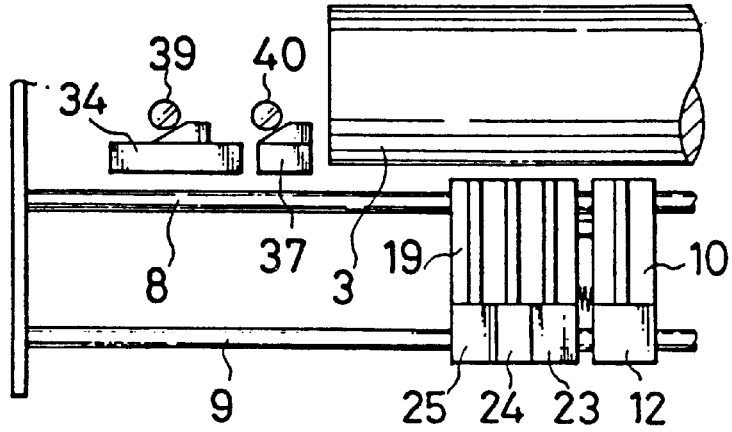

When the black carrier 10 is moved to the right, the black cap 37 and the color cap 34 are moved by a predetermined amount by the compression torsion springs 35 and 38 and the opening-closing cams 34*a* and 37*a* whereby the caps are released. Color printing is usually in one direction with the order of superposition of colors and the printing accuracy taken into account, and does not effect high-speed printing of draft characters or the like and therefore, even if the weight of the color carrier 19 is increased, the increase in the load to the carrier motor 30 is slight. In the suction recovering operation during color printing, when the carrier is at its home position as shown in FIG. 3B, capping is effected and the solenoid 44 is electrically energized as previously described, whereby the piston 41*a* is brought to the position shown in FIG. 2A and both of the black cap 37 and the color cap 34 are communicated with the pump 45, and the recovering motor 47 is rotated to operate the pump 45, whereby the suction recovering operation can be accomplished from all the black and color heads. Also, the solenoid 44 may be electrically deenergized during printing, and can be electrically energized only when the black carrier connects the color carrier 19 or when suction is effected from all heads, and thus, power consumption can be reduced.

Also, the present embodiment has been described with respect to a suction type recovering mechanism, but the present invention may use other recovering systems and further, can be carried out even in an ink jet recording apparatus having no recovering mechanism.

The ink for recovery may be supplied from the ink tank by a supply tube and in that case, the supply recovery of black ink which is high in frequency of use can be decreased and, thus, working efficiency can be improved.

As is apparent from the foregoing description, according to the above-described embodiment, there is provided an economical color ink jet recording apparatus in which the carrier for black printing and the carrier for color printing are separated from each other (that is, the scannings of the recording heads are separated from each other) and black printing is effected by the scanning of the black carrier and color printing is effected by the scanning of the black carrier and the color carrier, whereby the fluctuation of the load of the motor in the high-speed printing during black printing and the low-speed printing during color printing can be minimized and a compact and inexpensive motor can be used. It is not necessary to take the heating of the heads or the preliminary discharge, into consideration to prevent the color head from being secured to black prints, and, therefore, it is easy to control and does not wastefully consume the color ink.

Figure 4:
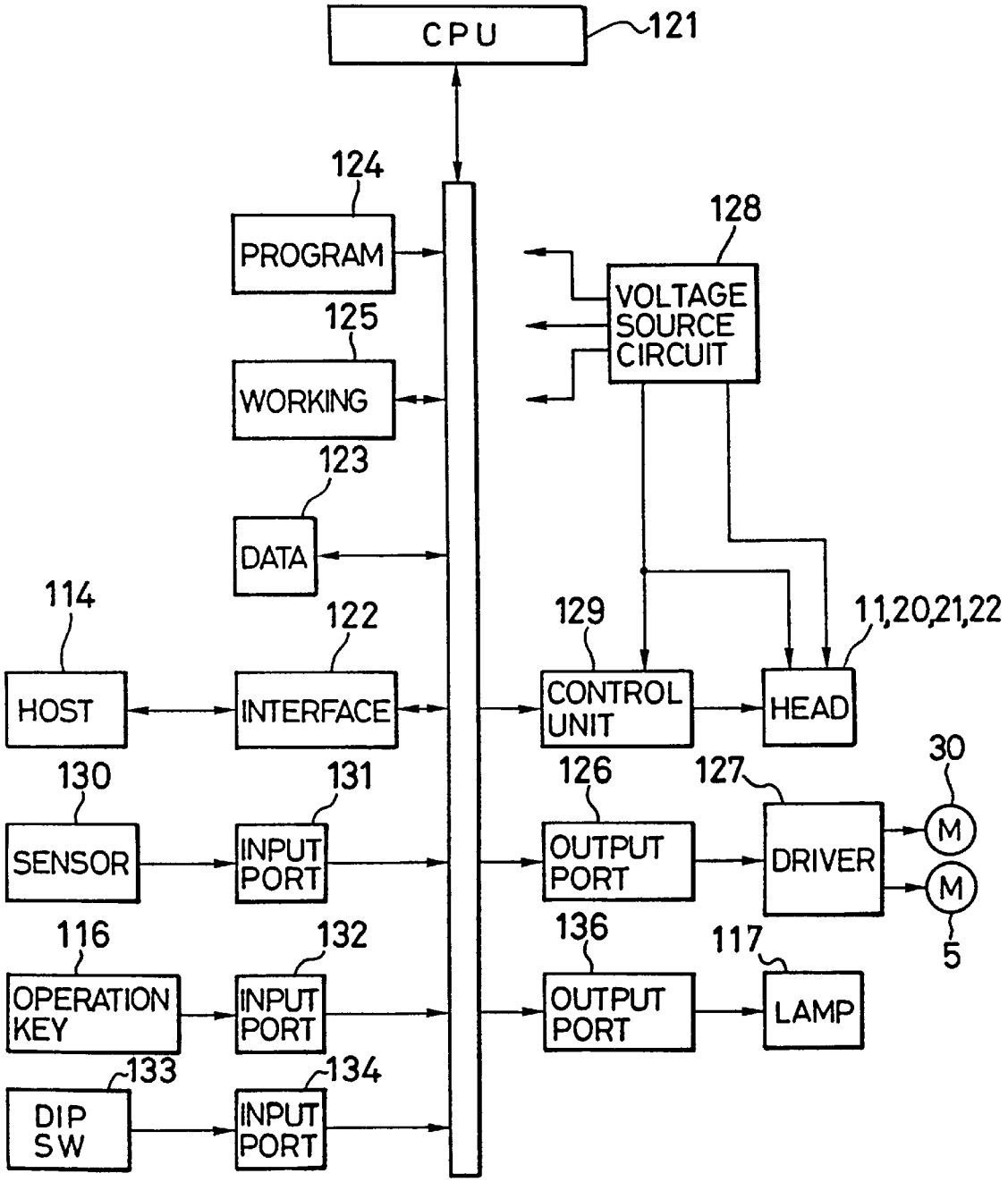
FIG. 4 is a block diagram of the control system of the recording apparatus of FIG. 1.

FIG. 4 is a block diagram showing the control system of the ink jet recording apparatus of FIG. 1.

In FIG. 4, a CPU (microprocessor) 121 is connected to a host machine 114 such as a computer through an interface 122, and controls the recording operation on the basis of a command signal and a record information signal read from the host machine into a data memory 123 and from a program stored in program memory 124 and a ROM such as a working memory 125.

The CPU 121 controls the carriage motor 30 (FIG. 1) and the sheet feeding motor 5 (FIG. 1) through an output port 126 and a motor driver 127, and also controls the recording heads 11, 20, 21 and 22 through a head control circuit 129 on the basis of record information stored in the data memory 123.

The reference numeral 130 in FIG. 4 designates a sheet sensor for detecting whether a recording medium 7 (FIG. 1) is present between conveying rollers, and the detection signal is transmitted to the CPU 121 through an input port 131.

The output of each operation key 116 on an operation panel is transmitted to the CPU 121 through an input port 132, and electricity is supplied to an alarm lamp 117, such as an alarm lamp or a voltage source lamp, through an output port 136.

The reference numeral 133 in FIG. 4 denotes a dip switch provided on the bottom surface of an armor, and the output thereof is transmitted to the CPU 121 through an input port 134.

In FIG. 4, a logic driving voltage VCC (5 V) for operating a control logic circuit, a voltage VM (30 V) for driving the various motors a reset voltage RESET, a heat voltage (head voltage) VH (25 V) for heating the dot forming elements of the recording heads 11, 20, 21 and 22, and a back-up voltage VDDH for protecting the recording heads are output from a voltage source circuit 128.

The operation of the control system of FIG. 4 will now be described with reference to the flow chart of FIG. 5.

After the initialization of the control unit step S101) during the closing of the main switch, the CPU 121 is in a reception standby state in which it can receive as input the control command and printing data of the host computer 114 connected to the printer, through the interface 122 (Step S102).

It is to be understood that color setting with the host computer in the present embodiment is executed in the following specification. The data from ESCn and on are determined by n.

n=0 is black, n=1 is R color, n=2 is G color, n=3 is B color, n=4 is Y color, n=5 is M color, and n=6 is C color.

When at step S102, printing data is input from the host computer 114 connected to the printer, the CPU 121 stores the date into a receiving buffer provided in a buffer for storing data 123, and repeats steps S102–S103 until it discriminates the completion of the reception of prescribed printing data from the host computer 114 (step S103).

When it discriminates the completion of the reception of the prescribed printing data from the host computer 114, the CPU 121 detects the aforementioned color setting at step S104. If ESC0 is transmitted, only the black head is judged at step S105 and advance is made to step S106, where only the black head is rendered drivable by the aforedescribed carrier separation.

Subsequently, at step S107, the capping process for the unused color head is carried out.

Further, at step S109, FLAG using only the black head is rendered ON so as to indicate the presence or absence of the suction recovery, the idle discharge, the temperature control of the heads and the ink detection which will be described later.

At step S110, the used head flag operated at step S109 is detected and the suction recovery (or the pressing and circulations of only the black head is executed.

At step S111, the used head flag operated at step S109 is detected and the idle discharge from only the black head is executed.

Further, again at step S112, the used head flag operated at step S109 is detected, and the heater carried on the head is turned on so that only the black head assumes a prescribed temperature, e.g. 35° C. or higher, whereby the black head is controlled by detecting a thermistor on the head.

At step S113, the used head flag operated at step S109 is detected as previously described and only the black ink is detected. Although the detecting method is not specifically shown, for example, an electrode is put between the inks and the presence or absence of the ink is detected from the resistance value thereof.

At step S114, the CPU 121 excites the carrier motor 30 in a rightward direction from an output port 126 through the driver 127 to move the carrier in a rightward direction toward a recording area.

Subsequently, at step S115, from the control circuit 129, printing data is set in the head 11.

After the setting, at step S116, a prescribed pulse is applied to the head 11. The pulse width at this time is prescribed by the next timer t1 (step S117). After the time is up, electrical energization of the head is cut off (step S118).

At step S119, in each cycle of electrical energization, 1 is added to a recording cycle counter provided in the working. Whether printing has been completed is discriminated by that recording cycle counter.

If at step S120, the recording cycle counter does not exceed a prescribed print dot value, return is made to step S113, and the operation of steps S113–S120 is repeated.

If at step S120, the recording cycle counter exceeds the prescribed print dot value, advance is made to step S121, where the carrier motor is excited in a leftward direction from the output port 126 through the driver 127 to move the carrier in a leftward direction 127 and the CR process is executed and at step S122, the LF process, i.e., the sheet feeding process, is carried out, whereby printing of one line is completed.

If at step S104, when ESC1 is transmitted, that is, R(Y+M) Y and M heads are discriminated at step 5105 and advance is made to step S108, where both the black head and the color head are rendered drivable by the aforedescribed carrier connecting process (step S108).

At step S109, FLAG using Y and M is turned on so as to indicate the presence or absence of the suction recovery, the idle discharge, the temperature control of the heads and the ink detection which will be described later.

At step S110 as previously described, the suction recovery of only the Y and M heads (color heads) is executed.

At step S111 as previously described, the idle discharge from only the Y and M heads is executed.

Further, at step S112, the heater carried on the head is turned on so that only the Y and M heads assume a prescribed temperature or higher The ON-OFF control of this heater is effected on the basis of the detection signal of a temperature detector such as a thermistor carried on each head.

Also at step S113, the detection control of only the Y ink and the M ink is executed so that printing can be executed even if the C ink and the black ink are absent.

Thereafter, printing of one line is executed by an operation procedure similar to that in the case of only black.

As is apparent from the foregoing description, according to the color ink jet recording apparatus of the present invention, the carrier for black printing and the carrier for color printing are separated from each other, whereby the idle discharge and the suction recovery of the head for preventing the adherence of the ink to the color head are also separeted from each other. The color ink is not unnecessarily consumed and it becomes easy to effect ink detection and temperature control for each head used and, thus, unnecessary controlling operations can be curtailed.

Figure 6:
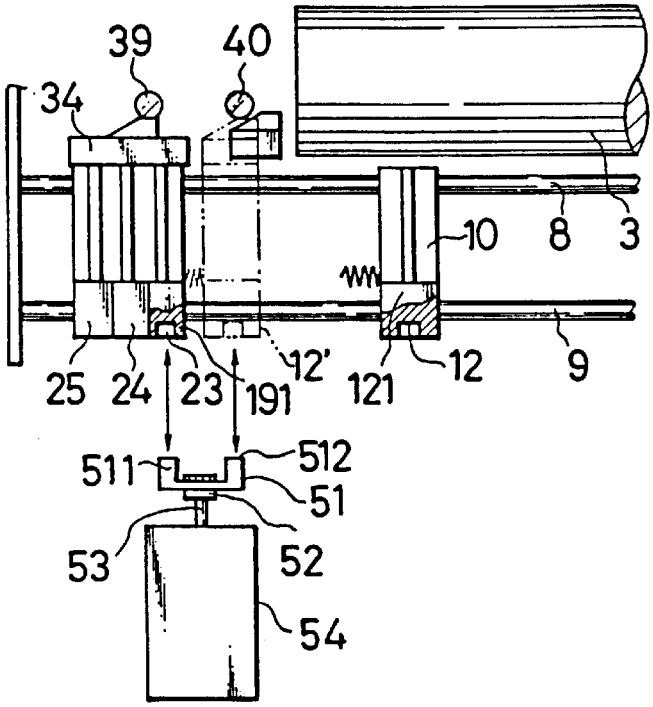
FIG. 6 illustrates another embodiment for effecting the connection and separation of the two carriages which are the essential portions of the present invention.
Figure 7:
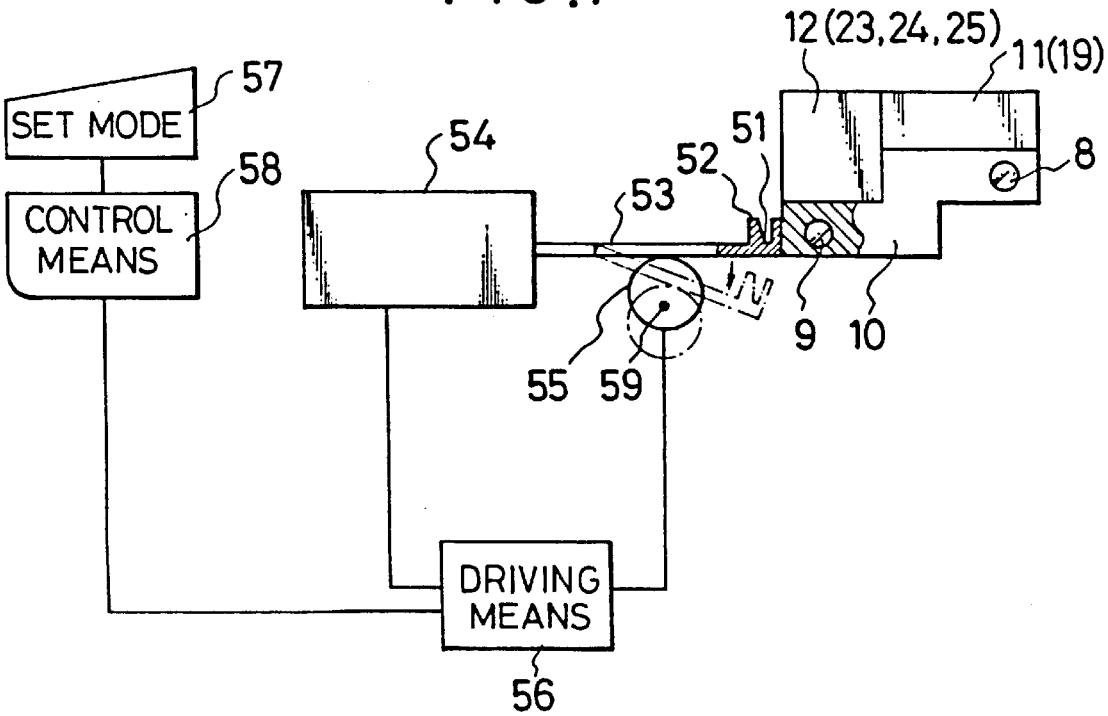
FIG. 7 is a conceptional view illustrating the control of FIG. 6.

FIGS. 6 and 7 show another example of the connecting and separating mechanism of the present invention, and more particularly shows a U-shaped connecting member 51 instead of the connecting lever 13. In the present example, the carriers 10 and 19 are made integral with each other by the U-shaped member 51 during connection and the U-shaped member 51 is removed during separation, whereby movement of only the carrier 10 becomes possible. The carriers 10 and 19 are provided with recesses 121 and 191 engaged in advance by the U-shaped member 51. The U-shaped member 51 has its movement controlled by a solenoid 54, and the engagement and separation between the U-shaped member 51 and the solenoid 54 are controlled by rotation of an eccentric cam 55. The solenoid 54 causes a pivotable shaft 53 having a U-shaped member supporting portion 52 formed with a V-shaped groove at the fore end thereof, to be moved in the direction of the arrows as indicated in FIG. 6. The pivotable shaft 53 is more a parallel by the cam 55 which is in a state indicated by a solid line in FIG. 7, and is lowered by gravity while being guided to the cam 55 as it is in a state indicated by a broken line in FIG. 7 of an 180° rotation of cam 55 relative to the center 59. Thereby the U-shaped member 51 and the supporting portion 52 are separated from each other. Conversely, when the pivotable shaft 53 is moved up to its solid-line position by further 180° rotation of the cam 55, the U-shaped member 51 and the supporting portion 52 become connected together. At this time, the supporting portion 52 returns in the direction of arrows, whereby the U-shaped member 51 is separated from the two carriers.

In the present embodiment, the connection and separation between the carriers 10, 19 and the U-shaped member 51 are effected at the home position shown in FIG. 3B, and such connection and separation are accomplished in conformity with the mode setting by mode setting means (automatic or manual 57. The reference numeral 56 designates drive means which governs the movement and rotation of the solenoid 54 and the cam 55. Control means 58 determines the timing of the operation and stoppage of the drive means 56, and controls said connection and separation. The control means 58 can operate only when both of the carriers 10 and 19 are at their home positions.

The control means 58 brings the solenoid 54 and the U-shaped member 51 into the normal standby state of FIG. 6 and brings the cam 55 into the solid-line state of FIG. 7 (the normal standby state) in response to the closing of the main switch or the recording completion signal, and maintains the pivotable shaft 53 rectilinearly movable. When the black printing mode is selected in this normal standby state, the drive means 56 is maintained as it is. Conversely, when the color printing mode is selected in this standby state, the control means 58 operates the solenoid 54 by the drive means to connect the carriers 10, 19 and the U-shaped member 51 together and thereafter separates the supporting portion 52 from the U-shaped member 51 by 180° rotation of the cam 55 (the state indicated by a dot-and-dash line in FIG. 7: the color mode standby state). Thereby the carriers 10 and 19 are made integral with each other and at the same time, scanning for recording becomes possible. When in subsequence to the color printing mode, the black printing mode is set manually or by the aforementioned automatic detection, the carriers 10 and 19 come to their home positions. At this time, the control means 58 causes further 180° rotation of the cam 55 by the drive means, and brings the supporting portion 52 into engagement with the U-shaped member 51. After the termination of this rotation of the cam, the solenoid pulls back the supporting portion by the control means 58, whereby the separation of the carriers 10 and 19 is accomplished. That is, again the control means maintains the respective carriers in said normal standby state.

Accordingly, by said control, appropriate carriers are selected for the black printing mode and the color printing mode, respectively. Assuming that the velocity of movement of the carrier 10 in the black printing mode is V cm/sec., the velocity of movement of the carriers 10 and 19 as a unit in the color printing mode is $\upsilon$ cm/sec. ($\upsilon$<V). Consequently, in the black printing mode, high-speed printing can be accomplished, and in the color printing mode, a printing speed suitable for color can be reliably obtained with the drive force kept in the same state.

Figure 5:
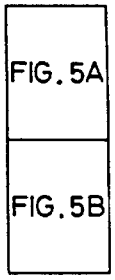
FIGS. 5A and 5B include a flow chart showing the operation procedure of the control system of FIG. 4.
Figure 5A:
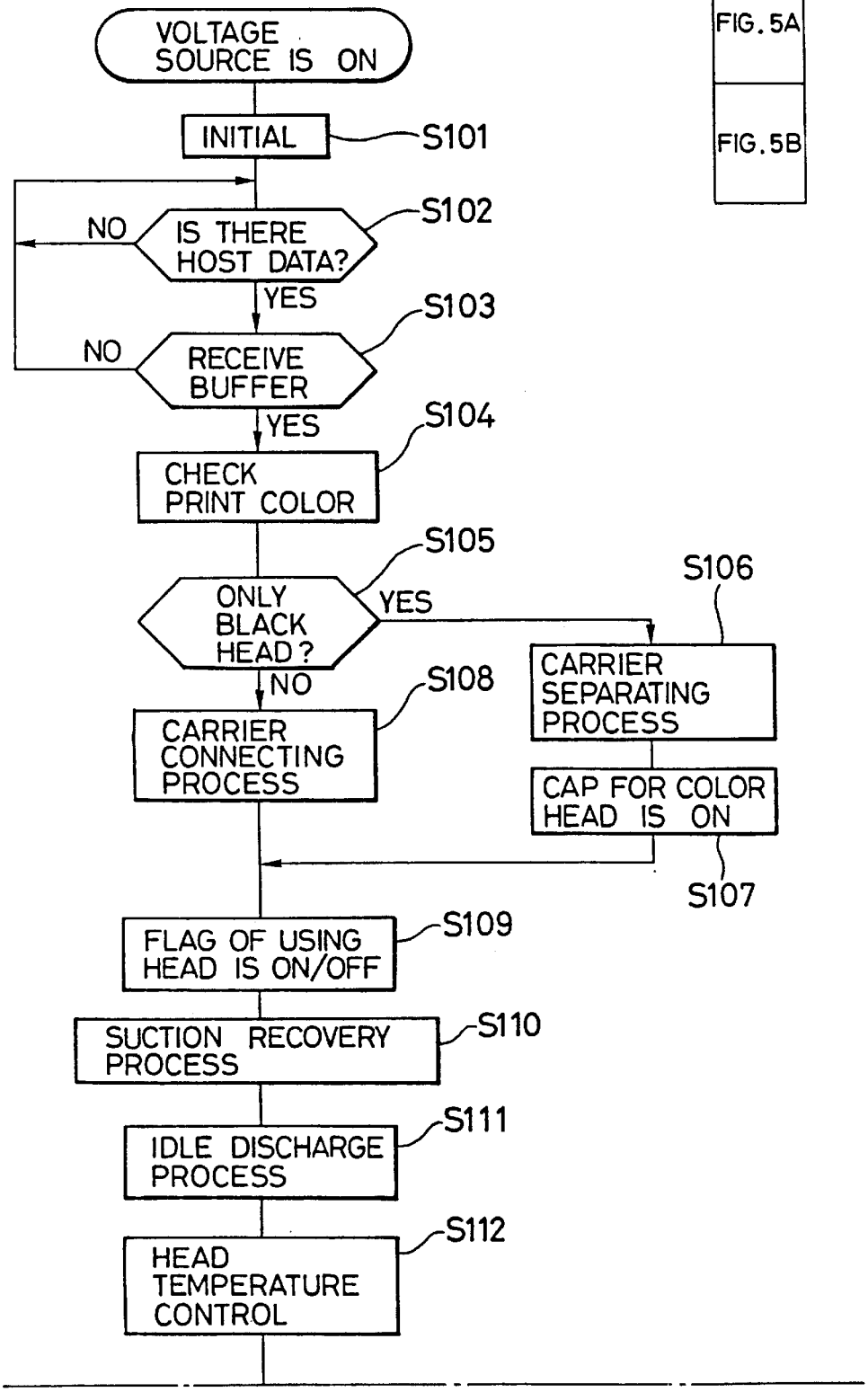
Figure 5B:
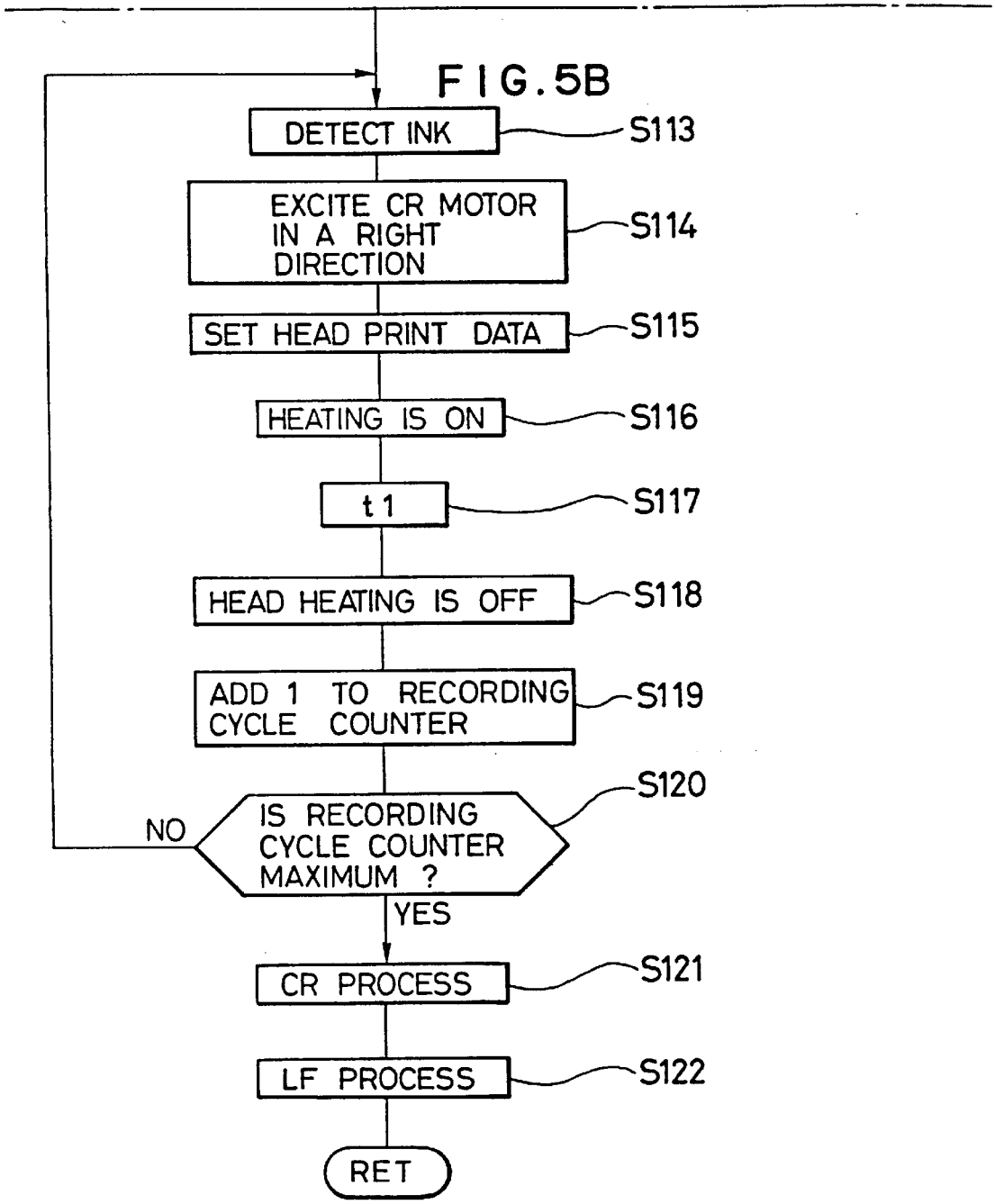
Figure 8:
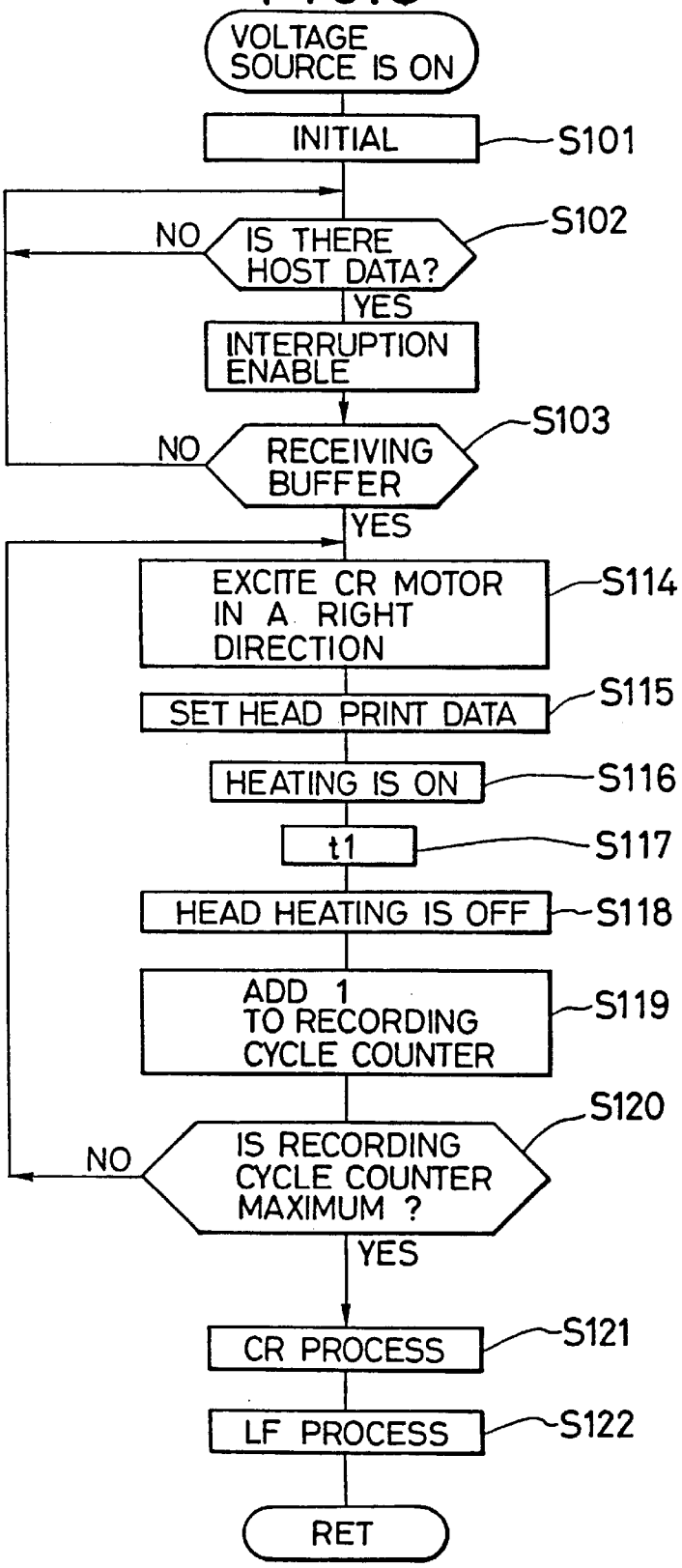
FIG. 8 is a flow chart of another embodiment of the control of the present invention.
Figure 9:
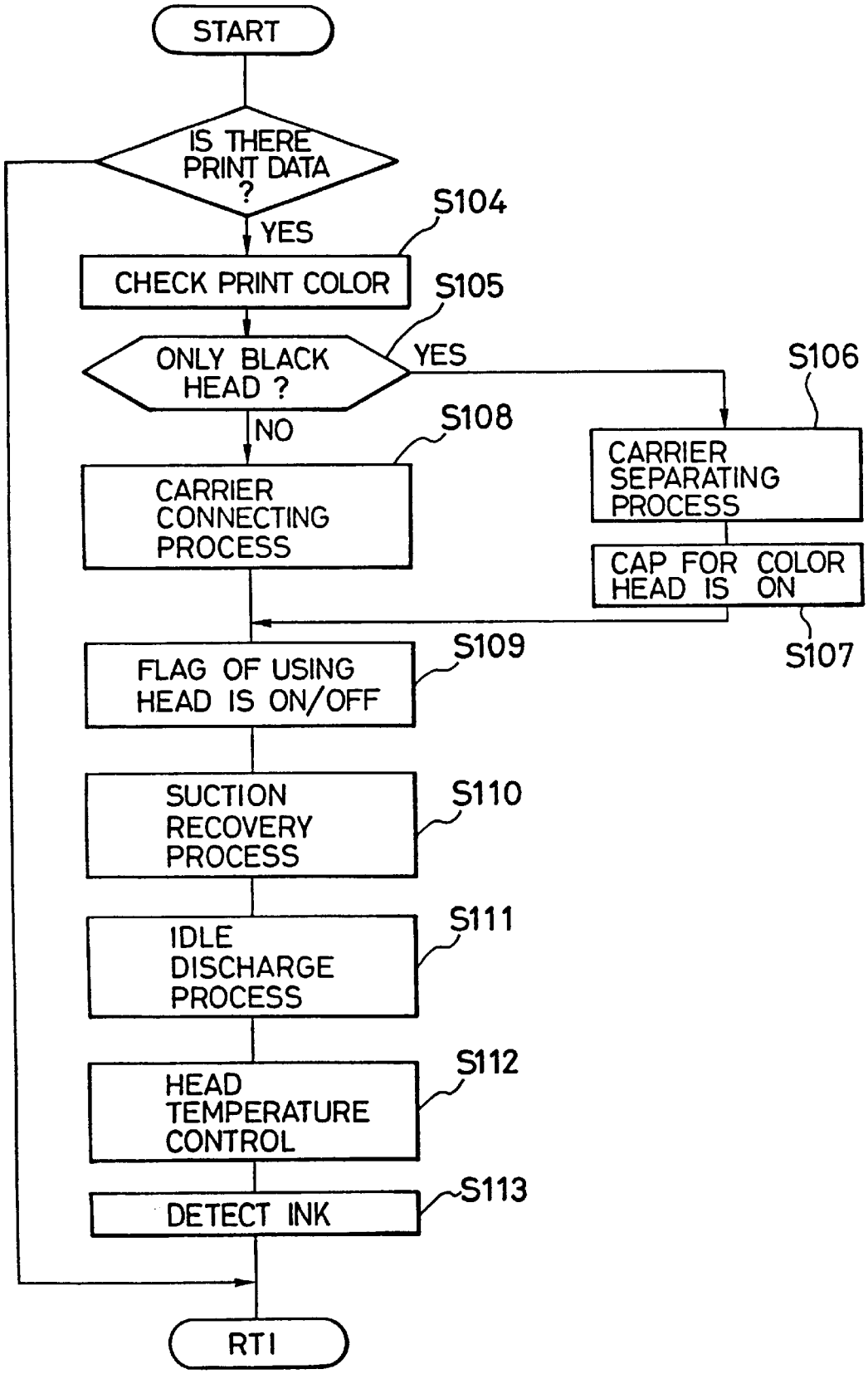
FIG. 9 is a flow chart of the interruption sub-routine of FIG. 8.

FIGS. 8 and 9 show a modification of the flow chart of FIG. 5 in which even when the carrier is moved in the black printing area, in a case where the black printing area is small and the rest is the color printing area in the printing area in one scan of the carrier, printing is effected with the carriers 10 and 19 as a unit and minimization of the whole recording time of one scan unit is accomplished That is, when the black printing area in one scan is less than 20% of one scan printing area, the carriers 10 and 19 are moved as a unit, and when said black printing area is 20% or more of one scan printing area, recording by only carrier 10 and recording by carriers 10 and 19 as a unit are effected via a change-over process. This discrimination is done by step S104 of FIG. 9 for checking the print color. The other steps are similar to the steps of FIG. 5, and only the differences will hereinafter be described. The above-mentioned percentage may be determined with 30% as the standard in an embodiment, but basically, by the return of the carriers during printing, it can be judged on the basis of the comparison with the time during which scanning is made with the carriers 10 and 19 as a unit, rather than the time required for the connection or separation of the carriers.

FIG. 8 shows the main routine which has the step of interruption ENABLE (or the command transmitting process to another CPU) between the step S102 of host data presence discrimination and the receiving buffer step S103. This interruption ENABLE is the interruption routine of FIG. 9 for checking the print color (or may be what is executed by another CPU having 2 chips), and is determined with the selection of the carrier necessary for printing being always discriminated from the print data.

The main routine of FIG. 8 excludes the print color checking step S104 of FIG. 5 to the ink detecting step S113 and therefore, appropriately drives the carrier determined by the "interruption ENABLE" and effects recording based on the received signal. The aforedescribed FIG. 5 shows a flow chart effective for the case where printing of one line can be processed by the same printing mode, and the case when a substantially different printing mode is on one line when that printing mode is to be recorded, the connection or separation of carriers 10 and 19 is effected with the carriers returned to their home positions without fail and only the appropriate carrier is scanned for that printing mode. In contrast with FIG. 5 in the main routine of FIG. 8, the data to be printed in the carrier state (the two carriers united or one carrier singly) discriminated by the "interruption ENABLE" is set at step S115, and loop until this data is completely printed, as provided by steps S114–S120. When this printing is completed, the data in the next printing area is already discriminated by the "interruption ENABLE" of the subroutine. When the result of this discrimination requires the change of carrier state, the carrier used in the previous printing is moved to the left home position at step S121, and immediately the carrier state is changed into a different carrier state and printing of the data being discriminated is effected. When, it is judged that the next printing area discriminated at this time can be continued with the carrier state of the previous printing kept, the carrier is not returned to the home position and recording is effected with the carrier state maintained by the return for printing. Thereafter, in a similar manners the above-described discrimination and recording are effected until all the data of the host to be printed are completely received by the buffer.

The interruption routine of FIG. 9 effects the discrimination for checking the aforedescribed printing data and minimizing the recording time, for each predetermined number of lines (or each line). Although, it is preferable to adopt this chart when in the black printing mode, when the next printing is judged as color printing and the connection of the carriers 10 and 19 is required. That is, it is preferable that only one of the heads 20, 21 and 22 on the carrier 19 in the standby state necessary for color printing be subjected in advance to the temperature control of step S112 or/and the ink detection of step S113 and shift be made to the printing stroke upon connection of the carriers. More preferably, the recording preparation processes such as the suction recovery process S310 and the idle discharge process S111 should be carried out in advance, in addition to the temperature control at S112.

In any case, in the present interruption routine, the signal transmitted between the steps S102 and S103 of FIG. 8 is discriminated with respect to an amount corresponding to a predetermined recording signal (preferably determined in conformity with the amount of memory), and if the result is the use of only the black head, steps 109–S113 are carried out via the steps S106 and S107. Conversely, if the result is the use of the color head and the black head, steps S109–S113 are carried out via the step S108. At the same time, the transmitted signal is received by the buffer and, therefore, the steps S114–S120 are carried out and the main routine is executed.

According to the present embodiment, the control, collectively expressed as an embodiment of the present invention, is realized and shortening of the recording time is achieved.

The above-described embodiments are ones in which the heads and carriers to be used in the black printing mode and the color printing mode in a color recording apparatus are selected for connection or separation, but the present invention can be applied to a recording apparatus in which different heads are used in arbitrary combination or singly in different recording modes. That is, if head 11 in the above-described embodiments is replaced with a single head of light black ink and heads 20, 21 and 22 are set as a single head of dark black ink, said control can be regarded as two modes, dark printing and light printing, instead of color printing and black printing. In such case, although limited to black printing, the printing speed of at least one mode (preferably the light printing mode) can be improved in conformity with the discrimination of the signal. If in the field wherein, conversely to the above-described embodiments, the main use is color printing, the positions of the carriers 10 and 19 are changed and said control is effected reversely, there will be provided a more preferable apparatus. Also, the recording heads 20, 21 and 22 may be replaced with only a single particular color head for use in a two-color recording apparatus.

The present invention covers all of the design changes and combinations included in the above-described technical idea.

According to the present invention, there can be provided a recording apparatus in which the desired main recording can be speed up without being limited to kinds of the recording heads (heads such as thermal transfer heads and piezo type ink jet heads) and other recording modes can also be suitably realized without greatly changing the drive source.

In the above-described embodiments, the carrier referred to herein is the carrier with the recording heads thereon, but it also includes a construction in which the recording heads themselves are used also as a carrier.

As the means for connecting and separating the carriers, adoption may be made of a construction in which a fixed permanent magnet (N pole) is provided on one carrier and a rotatable permanent magnet of variable S and N poles is provided on the other carrier and the selection of the S and N poles of the rotatable permanent magnet is variable in conformity with the selection of the recording modes, or a construction in which a metal is provided on one carrier and an electromagnet is provided on the other carrier and electrical energization of the electromagnet is changed over in conformity with mode selection to thereby accomplish the connection and separation of the carriers. The present invention covers all the connecting and separating means that adopt means capable of separating or connecting ordinary two constructions on the basis of the technical idea of the present invention.

Also, the present invention, when applied to a recording apparatus using as a recording head an ink jet recording heat having an electrothermal converting member generating head energy, is a particularly advantageous invention which can greatly decrease the recovery process of the head and the consumption of ink.

The above-described embodiment for discriminating the recording signal may be constructed so that when different prints other than the black printing mode (color prints or prints of a light color or the like) are present in one scan, printing is effected with the carriers 19 and 10 connected together and only in the case of the black printing mode in one scan are, the carriers 19 and 10 are separated from each other and printing effected by only carrier 10. Since generally the black printing is dominant, the effect of the present invention is sufficiently displayed.

We claim:

1. A recording apparatus comprising:

a first carrier;

a drive source for driving said first carrier;

a second carrier for carrying an ink jet head, said second carrier being connectable to said first carrier;

capping means for capping said ink jet head carried by said second carrier, said capping means being provided outside of a recording range; and means for switching between a first mode and a second mode, wherein in the first mode, said ink jet head is capped by said capping means, and in the second mode, said first carrier and said second carrier are connected and are capable of moving together to effect recording by the ink jet head in the recording range.

2. A recording apparatus according to claim 1, wherein the ink jet head is detachably mountable on said second carrier.

3. A recording apparatus according to claim 1, wherein said first carrier is of a smaller size than said second carrier.

4. A color ink jet recording apparatus of the serial type which effects printing by a carrier movable along a recording direction with a plurality of printing portions carried on said carriers said apparatus comprising:

a first carrier;

a drive source for driving said first carrier;

a second carrier for carrying a plurality of printing portions for printing various colors, said second carrier being connectable to said first carrier and movable by a drive force from said drive source when connected to said first carrier;

capping and suction recovery means for said printing portions carried on said second carrier; and a connecting portion for separating and connecting said first carrier and said second carrier.

5. A color ink jet recording apparatus according to claim 4, wherein the plurality of printing portions are detachably mountable on said second carrier.

6. A color ink jet recording apparatus according to claim 4, wherein said first carrier is of a smaller size than said second carrier.

7. A recording apparatus comprising:

a first carrier;

a drive source for driving said first carrier;

a second carrier for carrying thereon a recording head for effecting recording, said second carrier being connectable to said first carrier and movable by a drive force from said drive source when connected to said first carrier;

means for connecting and separating said first carrier and said second carrier; and control means for switching in conformity with a recording signal, between a first mode in which said second carrier is not moved and a second mode in which said first carrier and said second carrier are connected together by said connecting and separating means and moved together to thereby effect recording, wherein said control means discriminates a recording signal for one scan unit, and determines the first and second modes in response to said recording signal and in conformity with the presence or absence of recording by the recording head.

8. A recording apparatus according to claim 7, wherein the recording head is detachably mountable on said second carrier.

9. A recording apparatus according to claim 7, wherein said first carrier is of a smaller size than said second carrier.

10. A recording apparatus comprising:

a first carrier;

a drive source for driving said first carrier, a second carrier for carrying thereon a recording head for effecting recording, said second carrier being connectable to said first carrier and movable by a drive force from said drive source when connected to said first carrier;

means for connecting and separating said first carrier and said second carrier; and control means for switching, in conformity with a recording signal, between a first mode in which said second carrier is not moved and a second mode in which said first carrier and said second carrier are connected together by said connecting and separating means and moved together to thereby effect recording, wherein said control means switches between said first and second modes during one scan unit in accordance with a recording rate of the recording head by discriminating the recording signal during the one scan unit, wherein recording is performed by the recording head when the recording rate exceeds a predetermined recording rate and recording is performed by switching between the first and second modes when the recording rate is below the predetermined recording rate.

11. A recording apparatus according to claim 10, wherein the recording head is detachably mountable on said second carrier.

12. A recording apparatus according to claim 10, wherein said first carrier is of a smaller size than said second carrier.

13. A recording apparatus comprising:

a first carrier;

a drive source for driving said first carrier;

a second carrier for carrying a recording head thereon for recording with colors of ink other than black, said second carrier being connectable to said first carrier and movable by a drive force from said drive source when connected to said first carrier;

means for switching between first and second modes, wherein in the first mode, said first carrier is moved by said drive means, and in the second mode, said first carrier and said second carrier are connected and moved together by said drive means to thereby effect recording in a recording ranges the moving speed of said first carrier during the first mode being higher than the moving speed of said first carrier and said second carrier during the second mode.

14. A recording apparatus according to claim 13, wherein the recording head is detachably mountable on said second carrier.

15. A recording apparatus according to claim 13, wherein said first carrier is of a smaller size than said second carrier.

16. A recording apparatus comprising:

a first carrier;

a drive source for driving said first carrier;

a second carrier for carrying a recording head thereon, said second carrier being connectable to said first carrier and movable by a drive force from said drive source when connected to said first carrier;

drive means for moving said first carrier and said second carrier in first and second modes, wherein in the first modes the recording head carried on said second carrier is capped, and in the second mode, said first carrier is connected to said second carrier and said first carrier and said second carrier are moved together to thereby effect recording in a recording range.

17. A recording apparatus according to claim 16, wherein the recording head is detachably mountable on said second carrier.

18. A recording apparatus according to claim 16, wherein said first carrier is of a smaller size than said second carrier.

19. A recording apparatus comprising:

a first carrier;

a drive source for driving said first carrier;

a second carrier for carrying a recording head thereon, said second carrier being connectable to said first carrier and movable by a drive force from said drive source when connected to said first carrier;

means for switching between a first mode, a second mode, and a standby mode, wherein in the first mode said second carrier stands at a home position outside a recording area, in the second mode said first carrier and said second carrier are capable of being moved together to thereby effect recording in a recording range, and in the standby mode said first carrier and said second carrier stand by at the home position, and at the home position, said first carrier is positioned more adjacent to the recording area than said second carrier; and connecting means for integrally connecting said first carrier and said second carrier in the second mode, said switching means operating said connecting means only with said first carrier and said second carrier positioned at the home position.

20. A recording apparatus according to claim 19, wherein the recording head is detachably mountable on said second carrier.

21. A recording apparatus according to claim 19, wherein said first carrier is of a smaller size than said second carrier.

22. An apparatus comprising:

a first carrier;

a drive source for driving said first carrier;

a second carrier for carrying a head member thereon, said second carrier being connectable to said first carrier and movable by a drive force from said drive source when connected to said first carrier;

protecting means for protecting the head member when the head member is mounted on said second carrier and said second carrier is located at a protecting position; and means for switching between a first mode and a second mode, wherein in the first mode, said head member is protected by said protecting means, and in the second mode, said first carrier and said second carrier are connected and are capable of moving together.

23. An apparatus according to claim 22, wherein the head member is detachably mountable on said second carrier.

24. An apparatus according to claim 22, wherein said first carrier is of a smaller size than said second carrier.

25. A recording apparatus comprising:

a reciprocally movable carrier with a recording head mounted thereon;

a moving member reciprocally movable along a moving direction of said carrier by receiving a drive force from a drive source, said moving member having a coupling mechanism for coupling said moving member to said carrier; and a separation mechanism for separating said moving member from said carrier when said carrier is located at a predetermined position within a movable area.

26. A recording apparatus according to claim 25, wherein the predetermined position is a home position of said carrier.

27. A recording apparatus according to claim 26, wherein said recording head comprises an ink jet recording head for discharging ink through an ink discharge port.

28. A recording apparatus according to claim 25, wherein said recording head comprises an ink jet recording head for discharging ink through an ink discharge port.

29. An ink jet recording apparatus comprising:

a reciprocally movable carrier with an ink jet recording head mounted thereon, said ink jet recording head discharging ink through an ink discharge port;

a moving member reciprocally movable along a moving direction of said carrier by receiving a drive force from a drive source, said moving member having a coupling mechanism for coupling said moving member to said carrier; and a separation mechanism for separating said moving member from said carrier when said carrier is located at a predetermined position within a movable area.

30. An ink jet recording apparatus according to claim 29, wherein the predetermined position is a home position of said carrier.

31. A recording apparatus for recording on a recording medium disposed at a recording area with an ink jet recording head, said apparatus comprising:

a drive source;

a carrier for reciprocally moving the ink jet recording head along the recording area;

a moving member reciprocally movable along a moving direction of said carrier by receiving a drive force from said drive source;

a connecting member disposed on at least one of said carrier and said moving member to connect and integrally move said carrier and said moving member;

a capping mechanism located at a position for capping the ink jet recording head and within a movable area of said carrier; and a releasing mechanism for releasing a connection of said moving member and said carrier when said carrier is located at a position where the ink jet recording head mounted on said carrier is capped by said capping mechanism.

32. A recording apparatus for color recording on a recording medium disposed at a recording area with ink jet recording heads, said apparatus comprising:

a drive source;

a first carrier for reciprocally moving a group of color ink jet recording heads for disclarging inks of different colors along the recording area;

a second carrier movable along a moving direction of said first carrier by receiving a drive force from said drive source, said second carrier reciprocally moving along the recording area an ink jet recording head for discharging a blank ink;

a connecting member disposed on at least one of said first and second carriers to connect and integrally move said first and second carriers;

a capping mechanism located at a position for capping the group of color ink jet recording heads and within a movable area of said first carrier; and a releasing mechanism for releasing a connection of said first and second carriers when said first carrier is located at a position where the group of color ink jet recording heads mounted on said first carrier is capped by said capping mechanism.

* * * * *

UNITED STATES PATENT AND TRADEMARK OFFICE

CERTIFICATE OF CORRECTION

PATENT NO. : 5,907,334 Page 1 of 5

DATED : May 25, 1999

INVENTOR(S) : Hirano et al.

It is certified that error appears in the above-identified patent and that said Letters Patent is hereby corrected as shown below:

On the title page, item

[75] Inventors:

"Hirofumi Hirano; Shinichi Omo; Hiroshi Fukui, all of Yokosuka, Japan" should read --Hirofumi Hirano; Shinichi Omo, both of Yokohama; Hiroshi Fukui; Yokosuka, all of Japan--.

[56] References Cited:

OTHER PUBLICATIONS, line 2, "Powletko" should read --Pawletko-.

COLUMN 1:

Line 42, "an unused" should read --a--.
Line 43, "a" should read --unused--.
Line 45, "a" should read --unused--.

COLUMN 2;

Line 1, "operation,." should read --operation,--.
Line 15, "affecting" should read --effecting--.

UNITED STATES PATENT AND TRADEMARK OFFICE

CERTIFICATE OF CORRECTION

PATENT NO. : 5,907,334

DATED : May 25, 1999

INVENTOR(S) : Hirano et al.

It is certified that error appears in the above-identified patent and that said Letters Patent is hereby corrected as shown below:

COLUMN 3:

Line 8, "some-cases," should read --some cases,--.

Line 23, "particular," should read --particular recording head,-- and "printing therefore," should read --printing. Therefore,--.

Line 28, "the" should read --and the--.

Line 29, "and" should be deleted.

Line 41, "heads" should read --heads.--.

Line 49, "includes" should read --include:--.

Line 51, "head" should read --head is moved--.

COLUMN 4:

Line 58, "having" (first occurrence) should read --with--.

COLUMN 5:

Line 1, "systems" should read --system,--.

Line 4, "pin 24" should read --pin 14--.

Line 44, "portion 1a." should read --portion 10a.--.

Line 65, "compression torsion" should read --compression-torsion--.

UNITED STATES PATENT AND TRADEMARK OFFICE

CERTIFICATE OF CORRECTION

PATENT NO. : 5,907,334 Page 3 of 5

DATED : May 25, 1999

INVENTOR(S) : Hirano et al.

It is certified that error appears in the above-identified patent and that said Letters Patent is hereby corrected as shown below:

COLUMN 6:

Line 5, "thereinafter" should read --(hereinafter--.

COLUMN 7:

Line 33, "arrow 3," should read --arrow B,--.

Line 35, "gap At" should read --gap $\Delta l$--.

COLUMN 8:

Line 54, "motors" should read --motors,--.

Line 61, "step" should read --(step--.

COLUMN 9:

Line 9, "date" should read --data--.

Line 30, "circulations" should read --circulation)--.

COLUMN 10:

Line 6, "step 5105" should read --step S105--.

Line 36, "separeted" should read --separated--.

Line 57, "more a" should read --moved--.

Line 61, "of" should read --after--.

UNITED STATES PATENT AND TRADEMARK OFFICE

CERTIFICATE OF CORRECTION

PATENT NO. : 5,907,334

DATED : May 25, 1999

INVENTOR(S) : Hirano et al.

It is certified that error appears in the above-identified patent and that said Letters Patent is hereby corrected as shown below:

COLUMN 11:

Line 56, "rest is the" should read --remainder is--.

Line 59, "accomplished" should read --accomplished.--.

COLUMN 12:

Line 42, "printing kept," should read --printing,--.

Line 45, "manners" should read --manner,--.

COLUMN 13:

Line 40, "kinds" should read --particular kinds--.

Line 67, "heat" should read --head--.

COLUMN 14:

Line 2, "head" should read --heat--.

Line 11, "are," (first occurrence) should read --are-- and "are" (second occurrence) should be deleted.

COLUMN 15:

Line 19, "said first carrier," should read --said first carrier;-- and "a second carrier" should begin a new paragraph.

Line 61, "ranges" should read --range,--.

UNITED STATES PATENT AND TRADEMARK OFFICE

CERTIFICATE OF CORRECTION

PATENT NO. : 5,907,334 Page 5 of 5

DATED : May 25, 1999

INVENTOR(S) : Hirano et al.

It is certified that error appears in the above-identified patent and that said Letters Patent is hereby corrected as shown below:

COLUMN 16;

Line 9, "carrier;" should read "carrier; and".

Line 12, "modes" should read --mode,--.

COLUMN 18:

Line 22, "disclarging" should read --discharging--.

Signed and Sealed this

Twenty-eighth Day of November, 2000

*Attest:*

Q. TODD DICKINSON

*Attesting Officer*

*Director of Patents and Trademarks*